United States Patent [19]

Asano et al.

[11] Patent Number: 4,758,649

[45] Date of Patent: Jul. 19, 1988

[54] HEAT RESISTANT ORGANIC SYNTHETIC FIBERS AND PROCESS FOR PRODUCING THE SAME

[75] Inventors: Shoji Asano; Akio Ohmory, both of Kurashiki; Akitsugu Akiyama, Soja; Masanori Osawa, Yokohama; Kohei Shizuka, Fujisawa; Masahiro Kouno, Kanagawa, all of Japan

[73] Assignees: Kuraray Co., Ltd., Okayama; Mitsui Toatsu Chemicals, Inc., Tokyo, both of Japan

[21] Appl. No.: 49,253

[22] Filed: May 13, 1987

[30] Foreign Application Priority Data

May 21, 1986 [JP] Japan ..... 61-117970

[51] Int. Cl.[4] ..... C08G 18/06

[52] U.S. Cl. ..... 528/73; 264/178 F; 528/84; 528/348

[58] Field of Search ..... 528/73, 84, 348; 264/178 F

[56] References Cited

U.S. PATENT DOCUMENTS

| | | | |
|---|---|---|---|
| 3,445,557 | 5/1969 | Horoldt | 264/178 F |
| 3,984,375 | 10/1976 | Frost | 528/348 |
| 4,073,837 | 2/1978 | Kuzai et al. | 264/178 F |
| 4,245,066 | 1/1981 | Nakagawa et al. | 528/348 |

*Primary Examiner*—Maurice J. Welsh

[57] ABSTRACT

Heat resistant organic fibers comprising a wholly aromatic polymer having amide group and/or imide group, said fibers having properties satisfying the following formulas $$Tm \geqq 350^\circ\ C.,$$

$$Tm - Tex \geqq 30^\circ\ C.$$

$$Xc \geqq 10\%$$

$$DE \geqq 10\%$$

$$DSR(Tm) \leqq 15\%, \text{ and}$$

$$\frac{DSR(Tm + 55^\circ\ C.)}{DSR(Tm)} \leqq 3$$

wherein Tm is a melting point; Tex is an exotherm starting temperature; Xc is a degree or crystallization; DE is an elongation; DSR is a dry shrinkage factor at Tm; and DSR(Tm+55° C.) is a dry shrinkage factor at Tm+55° C. The process for producing the fibers is also disclosed.

8 Claims, No Drawings

HEAT RESISTANT ORGANIC SYNTHETIC FIBERS AND PROCESS FOR PRODUCING THE SAME

FIELD OF THE INVENTION

The present invention relates to heat resistant organic synthetic fibers and a process for producing the same. More particularly, the fibers of the present invention have general fiber properties comparable to those of conventional organic synthetic fibers together with such excellent form stability at a high temperature that heat shrinkage is very little even at a temperature higher than the melting point thereof and the fibers do not firmly fuse to each other upon combustion.

BACKGROUND OF THE INVENTION

Organic synthetic fibers have been hitherto widely used in clothes and industrial materials because they have excellent fiber properties. However, in the field where heat resistance is required, inorganic fibers such as asbestos, glass and steel are predominantly used and organic synthetic fibers are scarcely utilized.

Nevertheless, recently, development of heat resistant organic synthetic fibers has been conducted earnestly due to linking of the remarkable progress in organic synthetic chemistry with various needs in clothes, industrial materials, aviation and space developments and the like. As a result, various organic synthetic fibers have been developed. Among them, a representative which has achieved extreme success in commercial scale production is meta-wholly aromatic polyamide fibers mainly composed of poly-m-phenyleneisophthalamide (hereinafter abbreviated as PMIA).

PMIA fibers can be used within a working temperature range of 50° to 200° C. higher than that of known synthetic fibers, and they also have general properties necessary for general-purpose fiber products such as, for example, balanced strength and elongation, flexibility, post-processability and the like. Further, because the fibers have such a very high flame retardance with self-extinguishing characteristics that they do not flame up upon combustion and are extinguished immediately after removing flame, the fibers are utilized in various fields such as industrial materials, for example, heat resistant filter mediums, electrical insulating materials, etc.; clothes, for example, anti-heat protecting suits (e.g., fireman's suits, flying clothes, clothes for furnace workers, etc.); bedclothes; and the interior decoration field, and the range of their use is still increasing.

However, it has been found that PMIA fibers are yet insufficient for use in clothes such as anti-heat protecting suits and the like where form stability at a high temperature, for example, higher than the melting point of fibers is required. In order to deal with this point, it has been proposed to admix a small amount of para-wholly aromatic polyamide fibers [Seiji Tata, Plastic 36, 34 (1985)]. In this method, form stability at a high temperature is improved depending upon the mixing ratio. However, there is such a defect that flexibility and post-processability of PMIA fibers which are comparable to those of fibers for general-purpose clothes are drastically impaired because para-wholly aromatic polyamide fibers have extremely high stiffness and extremely low elongation for use as fibers for clothes.

Another problem is that, upon combustion, a product made of PMIA fibers are remarkable deformed due to heat shrinkage with causing firm fusion between fibers thereof to each other, although melt drip by melting of the fibers is not caused. Therefore, when such a product is accidentally burnt up during putting on as an anti-heat protecting suit, it is difficult to take off the suit, which makes an injury such as a burn rather worse.

Further, PMIA fibers are deficient in dyeing properties due to their polymeric construction and therefore they are not suitable for the field of clothes, particularly, for the fashion industry. In order to improve their dyeing properties, introduction of, for example, sulfone group is employed. However, other properties of the fibers are impaired due to such introduction, while improvement of dyeing properties is yet insufficient. In addition, apart from piece-dyeing with dyes, so-called solution dyed fibers colored with pigments are marketed. However, variety of colors is limited and further colors are limited to deep ones.

OBJECTS OF THE INVENTION

In view of the above problems of PMIA fibers, the present inventors have studied from the viewpoints of polymer synthesis, fiber production and fiber properties intensively to obtain organic synthetic fibers having general fiber properties comparable to those of conventional organic synthetic fibers together with such excellent form stability at a high temperature that heat shrinkage is very little even at a temperature higher than the melting point thereof, and that the fibers are not firmly fused to each other upon combustion, as well as such excellent dyeing properties that they do not require solution dyeing with pigments as with PMIA fibers and that they can be dyed by piece-dyeing with clear and a wide variety of colors.

As a result, it has been found that desired heat resistant organic synthetic fibers can be obtained by using a specific polymer having specific properties and selecting specific conditions for producing fibers having high crystallizability from the polymer.

One object of the present invention is to provide heat resistant organic synthetic fibers having general fiber properties comparable to those of conventional organic synthetic fibers together with such excellent form stability at a high temperature that heat shrinkage is very little even at a temperature higher than the melting point thereof and the fibers are not firmly fused to each other upon combustion.

Another object of the present invention is to provide heat resistant organic synthetic fibers having such excellent dyeing properties that they do not require solution dyeing with pigments and can be dyed by piece-dyeing with clear and a wide variety of colors.

These objects as well as other objects and advantages of the present invention will become apparent to those skilled in the art from the following description.

SUMMARY OF THE INVENTION

According to the present invention, there is provided heat resistant organic fibers comprising a wholly aromatic polymer having amide group and/or imide group, said fibers having properties satisfying the following formulas:

$$Tm \geqq 350° C. \quad (1)$$

$$Tm - Tex \geqq 30° C. \quad (2)$$

$$Xc \geqq 10\% \quad (3)$$

$$DE \geqq 10\% \quad (4)$$

$$DSR(Tm) \leqq 15\% \quad (5)$$

$$\frac{DSR(Tm + 55° C.)}{DSR(Tm)} \leqq 3 \quad (6)$$

wherein Tm is a melting point (°C.); Tex is an exotherm starting temperature (°C.); Xc is a degree of crystallization (%); DE is an elongation at break (%); DSR is a dry shrinkage factor at Tm (%); and DSR(Tm+55° C.) is a dry shrinkage factor at Tm+55° C. (%). The present invention also provides a process for preparing heat resistant organic fibers which comprises steps of wet-spinning a solution comprising a wholly aromatic polymer having amide group and/or imide group, stretching under wet heat conditions, washing with water, drying and stretching under dry heat conditions to obtain crystalline fibers, total draw ratio of said fibers satisfying the following formulas:

$$DD/WD \geqq 2 \quad (7)$$

$$DD \geqq 100\% \quad (8)$$

$$TD \geqq 200\% \quad (9)$$

wherein WD is a draw ratio in wet heat stretching (%); DD is a draw ratio in dry heat stretching (%); and TD is total draw ratio (%).

DETAILED DESCRIPTION OF THE INVENTION

The values of the properties used herein are those measured by using the following instruments under the following conditions.

Tm (melting point): A sample (about 10 mg) is placed in an aluminum dish and a DSC curve is prepared with DSC-2C manufactured by Perkin Elmer, Co. by raising temperature from room temperature to a predetermined temperature at the rate of 10° C./min. in a stream of nitrogen (30 ml/min.). Tm is the peak endothermic temperature of the DSC curve.

Tex (exotherm starting temperature): A sample (about 10 mg) is placed in an aluminum dish and a DSC curve is prepared with DSC-2C manufactured by Perkin Elmer, Co. by raising temperature from room temperature to a predetermined temperature at the rate of 10° C./min. in a stream of air (30 ml/min.). Tex is the exotherm starting temperature of the DSC curve.

Xc (degree of crystallization): By using a rotary paired cathodes type ultra-high strength X ray generating machine RAD-rA (40 KV, 100 mA, $CuK_2$ ray) manufactured by Rigaku Denki Kabushiki Kaisha, a sample is rotated within a vertical plane with respect to X ray beam to obtain an X ray diffraction strength curve at the diffraction angle ($2\theta$)=5° to 25°. The diffraction curve is divided into a crystal area (Ac) and an amorphous area (Aa) and Xc is calculated from the following formula:

$$Xc = \frac{Ac}{Ac + Aa} \times 100\ (\%)$$

DE (elongation of fibers): A tensile test is carried out by using Instron tensile tester under following conditions.

Sample length: 10 cm, elongation speed: 5 cm/min. and initial load: 0.05 g/d.

In the present invention, properties of the fibers should satisfy the formulas (1) to (4):

$$Tm \geqq 350° C. \quad (1)$$

$$Tm - Tex \geqq 30° C. \quad (2)$$

$$Xc \geqq 10\% \quad (3)$$

$$DE \geqq 10\% \quad (4)$$

That is, in the heat resistant organic synthetic fibers of the present invention, it has been found that the fibers have excellent form stability even at a temperature higher than the melting point thereof, when they have Tm (melting point) of not less than 350° C., Tex of 30° C. lower than Tm and Xc is not less than 10%.

In other words, when the fibers whose difference between Tm and Tex is not less than 30° C. (i.e., Tm−Tex≧30° C.) are compared with the fibers whose difference between Tm and Tex is less than 30° C. (i.e., Tm−Tex<30° C.), the former has superior form stability at a temperature higher than the melting point (Tm) thereof to that of the latter, even if they satisfy the requirements of Tm≧350° C. and Xc≧10%. Although this may seem to be inconsistent, in fact, the fibers having a lower Tex unexpectedly show better form stability.

This mechanism is yet unknown. However, it is considered that form stability would be improved as follows.

That is, in the fibers of the present invention which satisfy Tm≧350° C., Xc≧10% and Tm−Tex≧30° C., heat decomposition starts at relatively low Tex and therefore it gently takes place at about an amorphous area. In such a case, microcrystals remain at a crystal area without melting, and such microcrystals serve as restraint points of molecular chains against heat shrinkage which takes place concomitantly by relaxation of orientation in oriented molecular chains due to heat. This must inhibit shrinkage. In addition, a kind of cross-linking reaction takes place due to a simultaneously proceeding heat decomposition reaction to form three dimensional structure. Thus, form stability is improved even at a temperature higher than a melting point. To the contrary, in fibers which satisfy Tm≧350° C. and Xc≧10% but do not satisfy Tm−Tex≧30° C. (i.e., Tm−Tex of fibers are less than 30° C.) heat shrinkage and fusion between fibers become remarkable due to heat fusion before formation of the above three dimensional structure resulting from enough crosslinking between molecules.

In view of this, the range of Tm−Tex should be not less than 30° C., preferably, not less than 50° C., more preferably, not less than 70° C.

The fibers of the present invention have excellent form stability even at a temperature higher than the melting point (Tm) thereof. However, other fiber properties are impaired to some extent at a temperature higher than Tm. Therefore, in order to obtain heat resistant fibers which are practicable even at a temperature of 200° C. or more higher than that suitable for using ordinary synthetic fibers, Tm of the fiber of the present invention should be not less than 350° C., preferably, not less than 400° C., more preferably, not less than 420° C.

Further, when fiber, satisfy Tm≧350° C. and Tm−Tex≧30° C. but crystallizability thereof is low such as Xc<10%, restraint effect of microcrystals on molecular chain movement is scarcely expected. Therefore, heat shrinkage of fibers begins to rapidly increase when a temperature rises to about the glass transition temperature (Tg) thereof which is much lower than Tm to make form stability inferior.

In view of these reasons, Xc≧10%, preferably, Xc≧15% is required.

Furthermore, in order to use the fibers for clothes, industrial materials and the like in the same manner as conventional organic synthetic fibers, the fibers should have good dyeing properties as well as good flexibility and processability. For this purpose, balance between strength and elongation, particularly, sufficient elongation are of importance and therefore DE (fiber elongation) should be not less than 10% (i.e., DE≧10%), preferably, more than 15%, more preferably, more than 20%.

In addition, in order to further improve form stability at a high temperature of the fibers of the present invention, the fibers should satisfy the formulas (5) and (6):

$$DSR(Tm) \leqq 15\% \quad (5)$$

$$\frac{DSR(Tm + 55^\circ C.)}{DSR(Tm)} \leqq 3\% \quad (6)$$

wherein DSR is a dry shrinkage factor (%) at Tm; and DSR(Tm+55° C.) is a dry shrinkage factor (%) at Tm+55° C.

DSR is determined as follows.

Load of 0.1 g/d is applied to a sample of fibers in the form of yarn of 1200 d and 50 cm in length, and length ($l_0$) is measured. Then, the sample is treated in a hot air drier at a predetermined temperature without any load. After 30 minutes, load of 0.1 g/d is again applied to the sample and length ($l_1$) is measured and DSR is calculated from the following formula:

$$DSR = \frac{l_0 - l_1}{l_0} \times 100\ (\%)$$

When DSR(Tm) exceeds 15%, dry shrinkage already becomes too much at the melting point, which results in inferior form stability. In the case of DSR(Tm)≦15% but DSR(Tm+55° C.)/DSR(Tm)>3, heat shrinkage begins to rapidly increase when a temperature rises above the melting point. This is undesirable because, for example, when a product of the fibers is accidentally burnt up during putting on as an anti-heat protecting suit, it is difficult to take off the suit, which makes an injury such as a burn rather worse. Thus, it is of importance that the fibers should show quite little heat shrinkage even at a temperature much higher than the melting point (i.e., Tm+55° C.) such as DSR(Tm+55° C.)/DSR(Tm)≦3.

The heat resistant organic synthetic fibers of the present invention which satisfy the conditions of the above formulas (1) to (6) can be produced by using a wholly aromatic polymer having amide group and/or imide group as a starting material. Particularly, in the present invention, it is preferable to use a wholly aromatic polymer obtained from a combination of monomers selected from the group consisting of (a) an aromatic polyisocyanate and an aromatic polycarboxylic acid, (b) an aromatic polyisocyanate and an aromatic polycarboxylic acid anhydride, (c) an aromatic polyamine and an aromatic polycarboxylic acid, (d) an aromatic polyamine and an aromatic polycarboxylic acid halide, and (e) an aromatic polyamine and an aromatic polycarboxylic acid ester.

Representatives of the wholly aromatic polymer used in the present invention are a wholly aromatic polyamide having a repeating unit of the formula:

$$-[NH-Ar_1-NHOC-Ar_2-CO]- \quad [I]$$

wherein $Ar_1$ is a divalent phenylene residue of the formula:

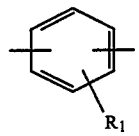

(wherein $R_1$ is a lower alkyl group having 1 to 4 carbon atoms, and the nitrogen atoms are attached to the divalent phenylene residue in 2,4- or 2,6-position with respect to $R_1$ and the ratio of 2,4-substitution:2,6-substitution is either 100:0 to 80:20 or 0:100 to 20:80); and $Ar_2$ is a divalent phenylene residue of the formula:

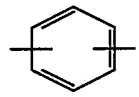

(wherein the carbonyl groups shown are attached to the divalent phenylene residue in 1,4- or 1,3-position and the ratio of 1,4-substitution:1,3-substitution is 100:0 to 80:20), a wholly aromatic polyimide having a repeating unit of the formula:

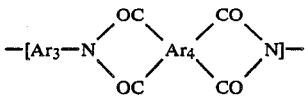

[II]

wherein $Ar_3$ is a divalent phenylene residue of the formula:

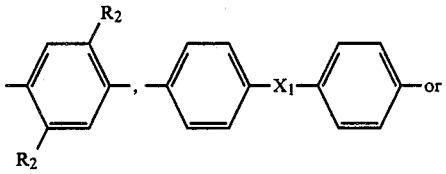

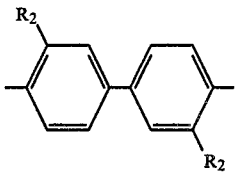

(wherein $R_2$ is hydrogen or a lower alkyl group having 1 to 4 carbon atoms; and $X_1$ is —O—, —CO— or —$CH_2$—); and $Ar_4$ is a tetravalent phenylene residue of the formula:

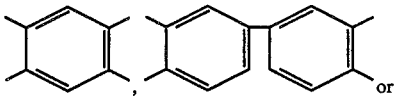

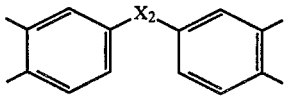

(wherein $X_2$ is —O— or —CO—), and a wholly aromatic polyamide-imide having a repeating unit of the formula:

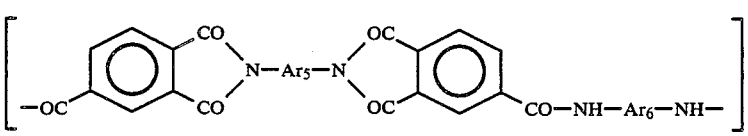

[III]

wherein $Ar_5$ is a divalent phenylene residue of the formula:

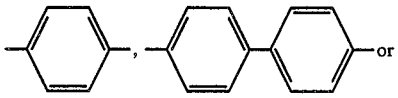

-continued

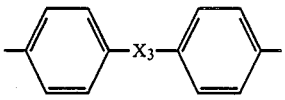

(wherein $X_3$ is —$CH_2$—, —O—, —S—, —SO—, —$SO_2$— or —CO—); and $Ar_6$ is a divalent group of the formula:

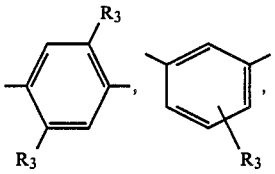

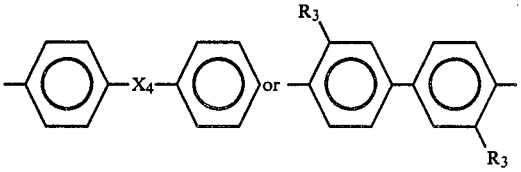

(wherein $R_3$ is hydrogen or a lower alkyl group having 1 to 4 carbon atoms; and $X_4$ is —$CH_2$—, —O— or —CO—).

The wholly aromatic polymers used in the present invention has been suggested in the prior art [see Journal of Polymer Science: Polymer Chemistry Edition, Vol. 15, 1905–1915 (1977); and Kogyo Kagaku Zasshi, Vol. 71, No. 3, pp 443–449 (1968)]. However, it is believed that the polymers have not been used heretofore in the prior art for fibers because it is impossible to obtain crystallized fibers suitable for practical use from the polymer disclosed in the prior art. Particularly, from the viewpoint of properties of the fibers, it is preferred to use these polymers having a logarithmic viscosity number of not less than 1.0 measured in 95% $H_2SO_4$ at 30° C. in the polymer concentration of 0.1 g/dl.

These polymers can be produced by polymerization or polycondensation of monomers such as the above-described combinations of monomers (a) to (e).

For example, the wholly aromatic polymers having the repeating units of the formulas [I], [II] and [III] can be produced by solution polymerization or melt polymerization of an aromatic polyisocyanate; and an polycarboxylic acid and/or its derivative such as anhydride, halide or ester, and the polymer having the repeating unit of the formula [I] can also be produced by solution polymerization or interfacial polycondensation of an aromatic diamine and an aromatic dicarboxylic acid.

That is, the wholly aromatic polyamide having the repeating unit of the formula [I] can be produced by solution polymerization or melt polymerization of an aromatic polyisocyanate such as tolylene-2,4-diisocyanate, tolylene-2,6-diisocyanate, or a mixture thereof and an aromatic polycarboxylic acid such as terephthalic acid, isophthalic acid or a mixture thereof. In this case, preferably, the molar ratio of tolylene-2,4-diisocyanate and tolylene-2,6-diisocyanate to be used as the starting materials is 100:0 to 80:20 or 0:100 to 20:80. Likewise, the molar ratio of terephthalic acid and isophthalic acid is preferably 100:0 to 80:20. That is, when a mixture of both diisocyanates and a mixture of polycarboxylic acids are used as the starting materials, preferably, one of the isocyanates is present in an amount of not more than 20 mole % and isophthalic acid is present in an amount not more than 20 mole %. When one of the isocyanates exceeds 20 mole % and isophthalic acid exceeds 20 mole %, crystallizability of the polymer is lowered due to disorder of regularity of the polymer structure and therefore desired properties of the fibers can not be obtained. Further, the polymer having the repeating unit of the formula [I] can also be produced by solution polymerization or interfacial polycondensation of a aromatic polydiamine such as 2,4-tolylenediamine, 2,6-tolylenediamine or a mixture thereof instead of the above aromatic polyisocyanate, and terephthalic acid, isophthalic acid, their derivative such as methyl terephthalate, methyl isophthalate, terephthalic acid chloride or isophthalic acid chloride, or a mixture thereof. Likewise, the molar ratio of 2,4-tolylenediamine and 2,6-tolylenediamine is preferably 100:0 to 80:20 or 0:100 to 20:80. The molar ratio of terephthalic acid or its derivative and isophthalic acid or its derivative is preferably 100:0 to 80:20 as described above.

Among the polymers having the repeating unit of the formula [I], those containing 4-methyl-1,3-phenyleneterephthalamide repeating unit and/or 6-methyl-1,3-phenyleneterephthalamide repeating unit in an amount of 95 mole % or more are preferred.

The wholly aromatic polyimide having the repeating unit of the formula [II] can be produced by solution polymerization or melt polymerization of an aromatic diisocyanate such as phenylene-1,4-diisocyanate, phenylene-2,5-dimethyl-1,4-diisocyanate, tolylene-2,5-diisocyanate, diphenylmethane-4,4'-diisocyanate, diphenylether-4,4'-diisocyanate, diphenylketone-4,4-diisocyanate, biphenyl-4,4'-diisocyanate, biphenyl-3,3'-dimethyl-4,4'-diioscyanate or the like, and an aromatic polycarboxylic acid anhydride, for example, pyromellitic dianhydride, diphenyl-3,3',4,4'-tetracarboxylic dianhydride, diphenylether-3,3',4,4'-tetracarboxylic dianhydride, diphenylketone-3,3',4,4'-tetracarboxylic dianhydride or the like.

The wholly aromatic polyamide-imide having the repeating unit of the formula [III] can be produced by solution polymerization or melt polymerization of an aromatic polyisocyanate such as phenylene-1,4-diisocyanate, phenylene-1,3-diisocyanate, tolylene-2,4-diisocyanate, tolylene-2,6-diisocyanate, diphenylmethane-4,4'-diisocyanate, diphenylether-4,4'-diisocyanate, diphenylketone-4,4'-diisocyanate, biphenyl-4,4'-diisocyanate, biphenyl-3,3'-dimethyl-4,4'-diisocyanate or the like, and bistrimellitic imide acid. Bistrimellitic imide acid used herein is produced by reacting 1 mole of an aromatic diamine such as p-phenylenediamine, 4,4',-diaminobiphenyl, 4,4'-diaminodiphenylmethane, 4,4'-diaminodiphenylether, 4,4'-diaminodiphenylketone, 4,4'-diaminodiphenylsulfide, 4,4'-diaminodiphenylsulfoxide, 4,4'-diaminodiphenylsulfone or the like with 2 mole of trimellitic anhydride and subjecting the resultant to intramolecular ring closure.

The fibers of the present invention are produced from these polymers as follows.

Firstly, a solution of the polymer is prepared. As a solvent for the polymers having the repeating units of the formulas [I], [II] and [III], there can be used linear or cyclic amides or phosphoryl amides such as N,N'-dimethylacetamide, N,N'-dimethylformamide, N-methylpyrrolidone, γ-butyrolactone, hexamethylphosphoric triamide and the like. In addition, a sulfoxide such as dimethyl sulfoxide, diphenyl sulfone or tetramethylene sulfone, sulfonic acid, or an urea such as tetramethyl urea or N,N'-dimethylethylene urea can be mixed with a solvent for the polymer having the repeating unit of the formula [I].

When the polymer is obtained in the form of a solution in the production step thereof, the solution can be used as it is.

The concentration of the polymer solution varies depending upon the molecular weight of a particular polymer used and the variety of a particular solvent used. However, usually, a polymer concentration in the solution is 5 to 30% by weight, preferably, 10 to 20% by weight. By using the polymer solution as a spinning solution which is usually maintained at 20° to 150° C., preferably, at 40 ° to 100° C., wet spinning is carried out and filaments thus spun are solidified in a coagulating bath to give gel filaments. The coagulating bath is an aqueous solution containing a metal salt, for example, $CaCl_2$, $ZnCl_2$, LiCl, LiBr or the like in an amount of 10 to 50% by weight, and further containing the same solvent as that of the spinning solution in such an amount that a total of the metal salt and the solvent is 20 to 70% by weight, as needed. The coagulating bath is usually maintained at 30° C. to the boiling point thereof, preferably, at 50° to 100° C.

After passing through the coagulating bath, gel filaments thus spun from a spinneret can be stretched in a wet heat stretching bath immediately. Alternatively, the filaments can be dipped in a solvent extracting bath to subject extraction treatment and then stretched in a wet heat stretching bath. The solvent extracting bath is an aqueous solution containing a metal salt in a concentration lower than that of the coagulating bath and further containing a solvent in a concentration lower than that of the coagulating bath, as needed. In this case, plural solvent extracting baths can be provided in such a manner that their concentration of the metal salt and the solvent are gradually lowered.

A wet heat stretching bath is used for stretching the resulting gel filaments in a wet state to promote molecular orientation thereof. It is possible to employ a hot water bath which does not contain any metal salt, any solvent and the like, after washing out a solvent and metal salts having swelling characteristics, as in conventional PMIA fibers. However, in the present invention, it is preferred to use a wet heat stretching bath containing a solvent and/or a metal salt as described hereinafter. Since the substantive purpose of the wet heat stretching bath is different from those of the coagulating bath for obtaining gel filaments and the solvent extracting bath for removing the solvent, the composition and the temperature of the wet heat stretching can be independently chosen. However, from the practical viewpoint, it is convenient to employ the same composition as that of the coagulating bath or the solvent extracting bath provided before or after the wet heat stretching bath. Likewise, the same temperature as that of the coagulating or solvent extracting bath can be employed from the viewpoint for saving energy. However, there are some cases wherein a higher temperature than that of the coagulating or solvent extracting bath is preferred.

After wet heat stretching, the filaments can be washed with water immediately to remove the solvent. Alternatively, the filaments can be dipped in plural solvent extracting baths wherein the concentrations of a metal salt and/or a solvent are gradually lowered and then washed with water usually at 40° to 100° C., preferably, 50° to 95° C. so that each concentration of the metal salt and the solvent becomes not more than 1%, preferably, 0.1%. The wet heat stretching can be effected at aonce in the above wet heat stretching bath or in separate steps suitable for desired stretching.

The wet draw ratio (WD %) used herein is a total draw ratio of filaments which are in a wet state and defined by the formula:

$$WD = \left(\frac{Vw}{V_1} - 1\right) \times 100\ (\%)$$

wherein $V_1$ is a speed of a first godet roller; and Vw is a maximum speed before drying.

Drying after washing with water is usually carried out at 30° to 250° C., preferably, 70° to 200° C.

The filament thus dried is subjected to dry stretching in air or an inert gas usually at 200° to 480° C., preferably, 330° to 450° C.

The dry draw ratio (DD %) used herein is defined by the formula:

$$DD = \left(\frac{Ve}{Vi} - 1\right) \times 100\ (\%)$$

wherein Vi is a speed of an inlet roller; and Ve is a speed of an exit roller.

The total draw ratio (TD %) is defined by the formula:

$$TD = \left[\left(\frac{WD}{100} + 1\right)\left(\frac{DD}{100} + 1\right) - 1\right] \times 100$$

In the present invention, the fibers should satisfy the following formulas (7) to (9):

$$DD/WD\sqrt{2} \quad (7)$$

$$DD \geqq 100\% \quad (8)$$

$$TD \geqq 200\% \quad (9)$$

Conventional PMIA fibers are usually produced under the conditions of $DD/WD < 1$ and $DD < 100\%$. That is, in conventional PMIA, the wet draw ratio is larger than the dry draw ratio. To the contrary, in the present invention, the dry draw ratio is larger than the wet draw ratio and is more than 100%. This is one of characteristics of the present invention. The mechanism of this is unknown. However, it is considered that, in the fibers of the present invention, a high WD cannot be employed because the glass transition temperature (Tg) in a wet state is not dropped below 100° C. which makes wet stretching difficult, whereas a high DD can be employed because a stretching temperature in a dry state can be raised sufficiently higher than Tg to increase molecular motion. However, it is of importance that a draw ratio should be as high as possible even in wet stretching to increase the total draw ratio (TD).

In order to increase wet stretching, it is preferred to carry out wet stretching of the fibers of the present invention under the following conditions:

$$25 \leqq S \leqq 150 \quad (10)$$

$$1 \leqq D \leqq 50 \quad (11)$$

$$10 \leqq C \leqq 50 \quad (12)$$

$$15 \leqq C + D \leqq 80 \quad (13)$$

$$40 \leqq Tw \leqq \text{boiling point of wet stretching bath} \quad (14)$$

wherein S is a solvent content (%) of a polymer; D is a solvent concentration (% by weight) of a wet stretching bath; C is a metal salt concentration (% by weight) of a wet stretching bath; and Tw is a temperature (°C.) of a wet stretching bath, although conventional PMIA fibers are stretched in hot water under the conditions of $S \leqq 23$. That is, in the present invention, it is desirable that the fibers contain a considerable amount of a solvent to facilitate polymer molecular motion and further a metal salt having swelling characteristics and a solvent are added to a wet stretching bath to facilitate polymer molecular motion, and thereby wet draw ratio (WD) becomes higher. In this manner, it is possible to carry out wet stretching at a draw ratio of $$30 \leqq WD \leqq 100.$$

As seen from the above description, it is of importance to employ a higher draw ratio in dry heat stretching. In this regard, it is preferred to carry out dry heat stretching in air or an inert gas under the following conditions:

$$350 \leqq Td \leqq 450 \quad (15)$$

$$100 \leqq DD \leqq 300 \quad (16)$$

wherein Td is a temperature (°C.) of dry stretching; DD is a dry drawing ratio (%).

The fibers of a wholly aromatic polymer having amide group and/or imide group thus obtained satisfy the above formulas (1) to (6) and have excellent form stability at a high temperature as well as excellent dyeing properties. Therefore, they are very practicable.

In the fibers of the present invention, particularly, those obtained from the aromatic polyamide having the repeating unit of the formula [I], it is considered the polyamide would contribute to the properties of the formulas (1) to (6) as follows.

Firstly, since $Ar_1$ has a lower alkyl group $R_1$, this lower alkyl group is oxidized at a temperature above Tex in the case that Tex is not higher than Tm−30° C., which causes a crosslinking reaction to form a three dimensional structure. This contributes to excellent form stability at a high temperature of the fibers. Further, the fibers of the present invention have practicable dyeing properties, and this results from the loose crystalline structure of the polymer due to the presence of the lower alkyl substituent on $Ar_1$ to facilitate absorption of dye. Therefore, it is desirable that $Ar_1$ is substituted by a lower alkyl group $R_1$.

Second, it is necessary that the nitrogen atoms are attached to the phenylene group of $Ar_1$ in 2,4- or 2,6-position with respect to $R_1$ and the ratio of 2,4-substitution: 2,6-substitution is either 100:0 to 80:20 or 0:100 to 20:80. If the polymer is outside of these ranges, regularity of the polymer molecular structure is remarkably disordered, which results in lowering of crystallizability. Therefore, the desired fibers which satisfy $Xc \geqq 10\%$ cannot be obtained.

Thirdly, it is preferred that $Ar_2$ is a divalent phenylene residue of the formula:

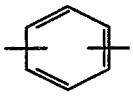

and the carbonyl groups are attached to the divalent phenylene residue in 1,4- or 1,3-position and the ratio of 1,4-substitution: 1,3-substitution is 100:0 to 80:20. If the polymer is outside of this range, the melting point of the resulting fibers are remarkably decreased. Therefore, the desired fibers which satisfy Tm≧350° C., preferably, Tm≧400° C. can not by obtained.

Thus, by selecting the specific structure and composition of the polymer as well as by selecting the specific conditions for the fiber production, the fibers which satisfy the above formulas (1) to (6) can be obtained.

The fibers of the present invention have balanced general fiber properties (e.g., strength, elongation, and Young's modulus) comparable to those of conventional organic synthetic fibers (e.g., polyethylene terephthalate fibers) together with unique properties which are not found in known heat resistant organic synthetic fibers such as PMIA fibers, i.e., such excellent form stability at a high temperature that heat shrinkage is very little even at a temperature higher than the melting point thereof and the fibers are not firmly fused to each other upon combustion. Further, dyeing properties of the fibers of the present invention are practicable and extremely superior to those of PMIA fibers, while inferior dyeing properties are said to be one of biggest defects of PMIA fibers. Therefore, based on excellent heat resistance, excellent form stability at a high temperature and further excellent dyeing properties, the fibers of the present invention can be used in a wide variety of fields such as protecting clothes, bedclothes and the interior decoration field.

The following examples and comparative examples further illustrate the present invention in detail but are not to be construed to limit the scope thereof.

EXAMPLE 1

Production of aromatic polyamide

A 3 liter separable flask equipped with a stirrer, a thermometer, a condenser, a dropping funnel and a nitrogen inlet tube was charged with terephthalic acid (166.0 g, 0.9991 mole), monopotassium terephthalate (2.038 g) and anhydrous N,N'-dimethylethylene urea (1,600 ml) under nitrogen atmosphere and heated with stirring to 200° C. on an oil bath. While maintaining the content at 200° C., a solution of tolylene-2,4-diisocyanate (174.0 g, 0.9991 mole) in anhydrous N,N'-dimethylethylene urea (160 ml) was added dropwise from the dropping funnel over 4 hours and the reaction was continued for additional 1 hours. Then, heating was discontinued and the reaction mixture was cooled to room temperature. A portion of the reaction mixture was taken up and poured into vigorously stirring water to precipitate a white polymer. The polymer was further washed with a large amount of water and dried at about 150° C. under reduced pressure for 3 hours. The logarithmic viscosity of the resulting polymer (95% $H_2SO_4$, 0.1 g/dl, 30° C.) was 2.2. The polymer content of the polymerization solution was about 11.0% by weight and the viscosity of the solution was 420 poise (Brookfield viscometer, 50° C.). Further, the identity of the polymer with poly(4-methyl-1,3-phenyleneterephthalamide) was confirmed by IR spectrum and NMR spectrum.

Production of poly(4-methyl-1,3-phenyleneterephthalamide) fibers

A spinning solution which was free from air bubbles was prepared by filtering the above polymerization solution at 50° C. under reduced pressure. Then, while maintaining at 50° C., the solution was spun from a spinneret having 600 circular holes (hole size: 0.11 mm in diameter) at a rate of 54.5 g/min into an aqueous coagulating bath containing 40% of $CaCl_2$ at 80° C. After passing the filaments spun from the spinneret through the coagulating bath, the filaments were wet-stretched at a draw ratio of about 1.6 times in a bath having the same composition as that of the coagulating bath. Further, the filaments were thoroughly washed with water in a washing bath containing hot water at 80° C. and, after picking up an oiling agent, the filaments were passed through a hot air dryer at 150° C. to dry them to obtain wet heat stretched spun raw filaments.

The spun raw filaments had elliptical cross section but were uniform. They were 2,900 d/600 filaments. The spun raw filaments were subjected to dry heat stretching at a draw ratio of about 2.4 times in a dy heat stretching machine at 430° C. under nitrogen atmosphere to obtain the poly(4-methyl-1,3-phenyleneterephthalamide) fibers of the present invention.

The fibers thus obtained had the following properties.

Single yarn denier: 2; Strength: 5.8 g/d; Elongation: 25.4%; Young's modulus: 88 g/d; Tm: 425° C.; Tex: 330° C.; Tm−Tex: 95° C.; Xc: 24%; DSR(Tm): DSR(425° C.)=13%;

$$\frac{DSR(Tm + 55° C.)}{DSR(Tm)} = \frac{DSR(480° C.)}{DSR(425° C.)} = \frac{18\%}{13\%} = 1.38$$

These figures show excellent general fiber properties as well as excellent form stability at a temperature higher than the melting point.

A knitted fabric was prepared by using fibers of the present invention and subjected to a combustion test. When flame was removed, fire was immediately extinguished and the fabric clearly showed self-extinguishing properties. Further, the fibers in a burnt part were not firmly fused to each other after combustion.

Furthermore, a dyeing test of the fibers of the present invention was carried out by using a dispersion dye (5% o.w.f.) with a carrier at 140° C. for 60 minutes. The fibers dyed in a medium degree or deeper with respect to four colors tested, i.e., red, blue, purple, and yellow. The degree of dye absorption was 60 to 85%.

EXAMPLE 2

Production of poly[(4-methyl-1,3-phenyleneterephthalamide)m (4-methyl-1,3-phenyleneisophthalamide)n] (m:n=9:1)

An aromatic polyamide was produced according to the same manner as described in Example 1 except that 10 mole % of terephthalic acid was replaced with isophthalic acid. The logarithmic viscosity of the resulting polymer was 2.3. The polymer content of the polymerization solution was about 11.9% by weight and the viscosity of the solution was 390 poise (50° C.). Further, the identity of the polymer with poly[(4-methyl-1,3-phenylene-terephthalamide)m (4-methyl-1,3-phenylene-isophthalamide)n] (m:n=9:1) was confirmed by IR spectrum and NMR spectrum.

Production of poly[(4-methyl-1,3-phenyleneterephthalamide)m (4-methyl-1,3-phenyleneisophthalamide)n] m:n=9:1) fibers Aromatic polyamide fibers were produced according to the same manner as described in Example 1 except that the spinning solution was replaced with the above-obtained polymerization solution.

The fibers obtained had the following properties.

Single yarn denier: 2; Strength: 5.3 g/d; Elongation: 29.3%; Young's modulus: 81 g/d; Tm: 410° C.; Tex: 315° C.; Tm−Tex: 95° C.; Xc: 20%; DSR(Tm): DSR(410° C.)=10%;

$$\frac{DSR(Tm + 55° C.)}{DSR(Tm)} = \frac{DSR(465° C.)}{DSR(410° C.)} = \frac{16\%}{10\%} = 1.6$$

These figures show excellent general fiber properties as well as excellent form stability at a temperature higher than the melting point.

A knitted fabric was prepared by using fibers of the present invention and subjected to a combustion test. When flame was removed, fire was immediately extinguished and the fabric clearly showed self-extinguishing properties. Further, the fibers in a burnt part were not firmly fused to each other after combustion.

Furthermore, the fibers had dyeing properties identical with those of Example 1 according to the same dyeing test as in Example 1.

COMPARATIVE EXAMPLE 1

Production of poly(m-phenyleneisophthalamide)

A 2 liter separable flask equipped with a stirrer, a thermometer and a jacketted dropping funnel was charged with isophthalic acid chloride (250.2 g, 1.232 mole) and anhydrous tetrahydrofuran (600 ml) to obtain a solution and the solution was cooled to 20° C. by passing a cooling medium through the jacket. A solution of m-phenylenediamine (133.7 g, 1.237 mole) in anhydrous tetrahydrofuran (400 ml) was added dropwise from the dropping funnel over about 20 minutes with vigorous stirring. The resulting white emulsion was quickly poured into ice-cooled water containing anhydrous sodium carbonate (2.464 mole) with vigorously stirring. The temperature of the resulting slurry was quickly raised to about room temperature. Then, after adjusting pH to 11 with sodium hydroxide, the slurry was filtered and the resulting cake was thoroughly washed with a large amount of water, dried overnight at 150° C. under reduced pressure to obtain the polymer, i.e., PMIA polymer. The logarithmic viscosity of the resulting polymer was 1.4.

Production of poly(m-phenyleneisophthalamide) fibers

A spinning solution which was free from air bubbles was prepared by dissolving the above-obtained PMIA powder in N-methyl-2-pyrrolidone (NMP) containing LiCl in to amount of 2% based on NMP to obtain a solution containing 22% by weight of NMP and deaerating the solution at 80° C. under reduced pressure. Then, while maintaining at 80° C., the solution was spun from a spinneret having 100 circular holes (hole size: 0.08 mm in diameter) at a rate of 5.2 g/min into an aqueous coagulating bath containing 40% of $CaCl_2$ at 80° C. The filaments spun from the spinneret were passed through a hot water bath at 80° C. via a roller rotating at 10 m/min. to thoroughly wash with water. Then, the filaments were subjected to wet heat stretching at a draw ratio of 2.88 times between rollers in hot water. After picking up an oiling agent, the filaments were passed through a hot air dryer at 150° C. to dry them to obtain wet heat stretched spun raw filaments.

The spun raw filaments had cocoon shaped cross section but were uniform. They were 358 d/100 filaments. The spun raw filaments were subjected to dry heat stretching at a draw ratio of 1.88 times on a heat plate at 310° C. to obtain poly(m-phenyleneisophthalamide) fibers.

The fibers thus obtained had the following properties.

Single yarn denier: 2; Strength: 4.9 g/d; Elongation: 28.5%; Young's modulus: 80 g/d; Tm: 425° C.; Tex: 405° C.; Tm−Tex: 20° C.; Xc: 25%; DSR(Tm): DSR(425° C.)=16%;

$$\frac{DSR(Tm + 55^\circ C.)}{DSR(Tm)} = \frac{DSR(480^\circ C.)}{DSR(425^\circ C.)} = \frac{61\%}{16\%} = 4.7$$

Although the PMIA fibers which are not within the scope of the present invention show excellent general fiber properties, it is clear that form stability at a temperature higher than the melting point is inferior to those of Examples 1 and 2.

A knitted fabric was prepared by using the above PMIA fibers and subjected to a combustion test. When flame was removed, fire was immediately extinguished and the fabric clearly showed self-extinguishing properties. However, the fibers in a burnt part were firmly fused to each other after combustion and lost their fibrous form.

Furthermore, a dyeing test of the above PMIA fibers was carried out according to the same manner as described above. In this case, the PMIA fibers hardly dyed in any color and dyeing properties were clearly inferior to those of Examples 1 and 2. The degree of dye absorption was 20 to 23%.

COMPARATIVE EXAMPLE 2

Production of poly(4-methyl-1,3-phenyleneisophthalamide)

The polymerization was carried out according to the same manner as in Example 1.

That is, a separable flask was charged with isophthalic acid (166.1 g, 1.0000 mole), monosodium isophthalate (0.9405 g) and anhydrous N,N'-dimethylethylene urea (1,000 ml) and the content was heated to 200° C. on an oil bath. While maintaining this temperature, a solution of tolylene-2,4-diisocyanate (174.1 g, 1.000 mole) in anhydrous N,N'-dimethylethylene urea (200 ml) was added dropwise from the dropping funnel over 4 hours and the reaction was continued for additional 1 hours. Then, heating was discontinued and the reaction mixture was cooled to room temperature. A portion of the reaction mixture was taken up and worked up as described in Example 1. The logarithmic viscosity of the resulting polymer was 2.2. The polymer content of the polymerization solution was 20.0% by weight and the viscosity of the solution was 230 poise (Brookfield viscometer, 80° C.).

Production of poly(4-methyl-1,3-phenyleneisophthalamide) fibers

A spinning solution which was free from air bubbles was prepared by filtering the above polymerization solution at 80° C. under reduced pressure. Then, while maintaining at 80° C., the solution was spun from a spinneret having 300 circular holes (hole size: 0.08 mm in diameter) at a rate of 17.0 g/min into an aqueous coagulating bath containing 41% of $CaCl_2$ at 80° C. The filaments spun from the spinneret through the coagulating bath were pressed through a hot water bath at 80° C. via a roller rotating at 10 m/min. to thoroughly wash with a water and then subjected to wet heat stretching at a draw ratio of 2.34 times between rollers in hot water at 98° C. After picking up an oiling agent, the filaments were passed through a hot air dryer at 150° C. to dry them to obtain wet heat stretched spun raw filaments.

The spun raw filaments had cocoon shaped cross section. They were 1,310 d/300 filaments. The spun raw filaments were subjected to dry heat stretching at a draw ratio of 2.18 times on a heat plate at 310° C. to obtain the poly(4-methyl-1,3-phenyleneisophthalamide) fibers.

The fibers thus obtained had the following properties.

Single yard denier: 2; Strength: 4.3 g/d; Elongation: 35%; Young's modulus: 81 g/d; Tm: 390° C.; Tex: 290° C.; Tm−Tex: 100° C.; Xc: 25%; DSR(Tm): DSR(390° C.)=83%

Thus, although general fiber properties are good, heat shrinkage at a temperature higher than the melting point is remarkable and form stability is inferior. In order to determine the value of the formula:

$$\frac{DSR(Tm + 55^\circ C.)}{DSR(Tm)},$$

measurement of (Tm+55° C.)=DSR (445° C.) was needed. However, it was impossible to measure it because any proper sample could not be obtained due to remarkable deformation of fibers.

A combustion test was carried out according to the same manner as in Examples 1 and 2 and the fabric sample showed clearly showed self-extinguishing properties. However, shrinkage of knitted fabric were remarkable and the fibers in a burnt part were firmly fused to each other after combustion.

COMPARATIVE EXAMPLE 3

Production of poly[(4-methyl-1,3-phenyleneterephthalamide)m (4-methyl-1,3-phenyleneisophthalamide)n] (m:n=70:30)

The title polymer was produced according to the same manner as described in Example 1 by using the following starting materials.

terephthalic acid: 116.3 g (0.7000 mole), isophthalic acid: 49.8 g (0.3000 mole), monopotassium terephthalate: 1.021 g, tolylene-2,4-diisocyanate: 174.1 g (0.9997 mole), N,N'-dimethylethylene urea: 1,600 ml.

The logarithmic viscosity of the resulting polymer was 1.8. The polymer content of the polymerization solution was 20.0% by weight and the viscosity of the solution was 340 poise (Brookfield viscometer, 80° C.).

Production of
poly[(4-methyl-1,3-phenyleneterephthalamide)m (4-methyl-1,3-phenyleneisophthalamide)n] (m:n=70:30) fibers The title fibers were produced according to the same manner as described in Comparative Example 2 by using the above polymerization solution as the spinning solution.

The fibers thus obtained had the following properties.

Single yarn denier: 2; Strength; 4.8 g/d; Elongation: 31%; Young's modulus: 83 g/d; Tm: 395° C.; Tex: 298° C.; Tm−Tex: 77° C.; Xc: 16%; DSR(Tm): DSR(395° C.)=20%;

$$\frac{DSR(Tm + 55^\circ C.)}{DSR(Tm)} = \frac{DSR(450^\circ C.)}{DSR(395^\circ C.)} = \frac{81\%}{20\%} = 4.05$$

Thus, the title fibers which are not within the scope of the present invention have a low melting point and dry heat shrinkage is rapidly increased at a temperature above the melting point. Therefore, their form stability at a high temperature is inferior in comparison with the aromatic polyamide fibers in Examples 1 and 2.

EXAMPLE 3

Production of aromatic polyimide

A 3 liter separable flask equipped with a stirrer, a thermometer, a condenser, a dropping funnel and a nitrogen inlet tube was charged with pyromellitic dianhydride (PMDA) (120.01 g, 0.5503 mole), anhydrous N-methyl-2-pyrrolidone (2,200 ml) and heated with stirring to 180° C. on an oil bath. While maintaining the content at 180° C., a solution of biphenyl-3,3'-dimethyl-4,4'-diisocyanate (TODI) (146.13 g, 0.5530 mole) in anhydrous N-methyl-2-pyrrolidone (200 ml) was added dropwise from the dropping funnel over 30 minutes and the reaction was continued for additional 30 minutes. Then, heating was discontinued and the reaction mixture was cooled to room temperature. A portion of the reaction mixture was taken up and poured into vigorously stirring water to precipitate a pale yellow polymer. The polymer was further washed with a large amount of water and dried at about 150° C. under reduced pressure for 3 hours. The logarithmic viscosity of the resulting polymer (95% $H_2SO_4$, 0.1 g/dl, 36° C.) was 1.20. The polymer concentration of the polymerization solution was about 9.9% by weight and the viscosity of the solution was 300 poise (Brookfield viscometer, 50° C.).

Production of poly(TODI/PMDA)imido fibers

The above polymerization solution was condensed to the polymer concentration of 12% by weight at 90° C. under reduced pressure. The solution was deaerated at 90° C. under reduced pressured to obtain a spinning solution which was free from air bubbles. Then, while maintaining at 90° C., the solution was wet-spun from a spinneret having 600 circular holes (hole size: 0.09 mm in diameter) into an aqueous coagulating bath containing 30% of $CaCl_2$ and 10% of N-methyl-2-pyrrolidone at 90° C. The gel filaments spun from the spinneret were dipped in a solvent extracting bath containing 20% of $CaCl_2$ and 5% of N-methyl-2-pyrrolidone at 90° C. to adjust the solvent content in the fibers to 50%/polymer. The fibers were led to a wet heat stretching bath containing 20% of $CaCl_2$ and 5% of N-methyl-2-pyrrolidone at 90° C. to effect wet heat stretching at a draw ratio of 1.4 times. Further, the fibers were thoroughly washed with hot water at 90° C. After picking up an oiling agent, the filaments were dried with hot air at 180° C., led to a dry heating oven at 445° C. and subjected to dry heat stretching with a stretching machine at a draw ratio of 2.5 times to obtain poly(TODI/PMDA)imide fibers.

The fibers thus obtained has the following properties.

Single yarn denier: 1.5, Strength: 4.3 g/d; Elongation: 19.5%; Young's modulus: 112 g/d; Tm: 430° C.; Tex: 395° C.; Tm−Tex: 35° C.; Xc: 13%; DSR(Tm): DSR(430° C.)=13%;

$$\frac{DSR(Tm + 55^\circ C.)}{DSR(Tm)} = \frac{DSR(485^\circ C.)}{DSR(430^\circ C.)} = \frac{25\%}{13\%} = 1.92$$

These figures show excellent general fiber properties as well as excellent form stability at a temperature higher then the melting point.

EXAMPLE 4

Production of aromatic polyamide-imide

A 3 liter separable flask equipped with a stirrer, a thermometer, a condenser, a dropping funnel and a nitrogen inlet tube was charged with diphenylmethane-4,4'-bis(trimellitic imide acid ) (DMTMA) (273.10 g, 0.5000 mole), monopotassium terephthalate (1.021 g) and anhydrous N-methyl-2-pyrrolidone (2,500 ml) under nitrogen atmosphere and heated with stirring to 180° C. on an oil bath. While maintaining the content at 180° C., tolylene-2,4-diisocyanate (2,4-TDI) (87.07 g, 0.5000 mole) was added dropwise from the dropping funnel over 2 hours and the reaction was continued for additional 30 minutes. Then, heating was discontinued and the reaction mixture was cooled to room temperature. A portion of the reaction mixture was taken up and poured into vigorously stirring water to precipitate a pale yellow polymer. The polymer was further washed with a large amount of water and dried at 150° C. under reduced pressure for 3 hours. The logarithmic viscosity of the resulting polymer (95% $H_2SO_4$, 0.1 g/dl, 30° C.) was 1.30. The polymer concentration of the polymerization solution was about 11.0% by weight and the viscosity of the solution was 550 poise (Brookfield viscometer, 50° C.).

Production of poly(DMTMA/2,4-TDI)amide-imide fibers

A spinning solution which was free from air bubbles was prepared by filtering the above polymerization solution at 50° C. under reduced pressure. Then, while maintaining at 50° C., the solution was spun from a spinneret having 1,000 circular holes (hole size: 0.08 mm in diameter) into an aqueous coagulating bath containing 35% of $CaCl_2$ and 5% of N-methyl-2-pyrrolidone at 80° C. The gel filaments spun from the spinneret were subjected to wet heat stretching at a draw ratio of 1.5 times in a wet heat stretching bath containing 20% of $CaCl_2$ and 3% of N-methyl-2-pyrrolidone at 80° C. Then, the filaments were dipped in a solvent extracting bath having the same composition and temperature as those of the wet heat stretching bath. Further, the filaments were led to a second solvent extracting bath containing 10% of $CaCl_2$ and 1% of N-methyl-2-pyrrolidone at 80° C. and then a third solvent extracting bath containing 5% of $CaCl_2$ and 0.5% of N-methyl-2-pyrrolidone at 80° C. Then, the filaments were washed with hot water at 80° C. and dried in hot air at 150° C. The resulting filaments were led to a dry heating oven at 400° C. and subjected to dry heat stretching with a stretching machine at a draw ratio of 2.3 times to obtain poly(DMTMA/2,4-TDI)amide-imide fibers.

The fibers thus obtained had the following properties.

Single yarn denier: 2; Strength: 4.0 g/d; Elongation: 28%; Young's modulus: 70 g/d; Tm: 390° C.; Tex: 295° C.; Tm−Tex: 95° C.; Xc: 11%; DSR(Tm): DSR(390° C.)=11%;

$$\frac{DSR(Tm + 55^\circ C.)}{DSR(Tm)} = \frac{DSR(445^\circ C.)}{DSR(390^\circ C.)} = \frac{24\%}{11\%} = 2.18$$

These figures show excellent general fiber properties as well as excellent form stability at a temperature higher then the melting point.

What is claimed is:

1. Heat resistant organic fibers comprising a wholly aromatic polymer having amide group and/or imide group, said fibers having properties satisfying the following formulas $Tm \geqq 350^\circ C.$, $Tm - Tex \geqq 30^\circ C.$, $Xc \geqq 10\%$ $DE \geqq 10\%$ $DSR(Tm) \leqq 15\%$ and $$\frac{DSR(Tm + 55^\circ C.)}{DSR(Tm)} \leqq 3$$

wherein Tm is a melting point (°C.); Tex is an exotherm starting temperature (°C); Xc is a degree of crystallization (%); DE is an elongation (%); DSR is a dry shrinkage factor (%) at Tm; and DSR(Tm+55° C.) is a dry shrinkage factor (%) at Tm+55° C.; said wholly aromatic polymer being obtained from a combination of monomers selected from the group consisting of (a) an aromatic polyisocyanate and an aromatic polycarboxylic acid, (b) an aromatic polyisocyanate and an aromatic polycarboxylic acid anhydride, (c) an aromatic polyamine and an aromatic polycarboxylic acid, (d) an aromatic polyamine and an aromatic polycarboxylic acid halide, and (e) an aromatic polyamine and an aromatic polycarboxylic acid ester.

2. Fibers according to claim 1, wherein the wholly aromatic polymer is a wholly aromatic polyamide having a repeating unit of the formula:

$$-[NH-Ar_1-NHOC-Ar_2-CO]-$$

wherein $Ar_1$ is a divalent phenylene residue of the formula:

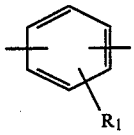

(wherein $R_1$ is a lower alkyl group having 1 to 4 carbon atoms, and the nitrogen atoms are attached to the divalent phenylene residue in 2,4- or 2,6-position with respect to $R_1$ and the ratio of 2,4-substitution: 2,6-substitution is either 100:0 to 80:20 or 0:100 to 20:80); and $Ar_2$ is a divalent phenylene residue of the formula:

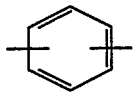

(wherein the carbonyl groups shown are attached to the divalent phenylene residue in 1,4- or 1,3-position and the ratio of 1,4-substitution:1,3-substitution is 100:0 to 80:20).

3. Fibers according to claim 1, wherein not less than 95 mole % of the repeating unit of the polymer is 4-methyl-1,3-phenyleneterephthalamide and/or 6-methyl-1,3-phenyleneterephthalamide.

4. Fibers according to claim 1, wherein the polymer is a wholly aromatic polyimide having a repeating unit of the formula:

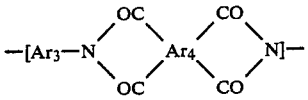

wherein $Ar_3$ is a divalent phenylene residue of the formula:

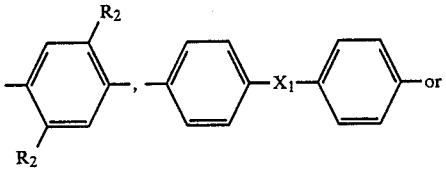

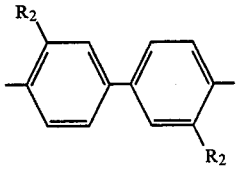

(wherein $R_2$ is hydrogen or a lower alkyl group having 1 to 4 carbon atoms; and $X_1$ is —O—, —CO— or —$CH_2$—); and $Ar_4$ is a tetravalent phenylene residue of the formula:

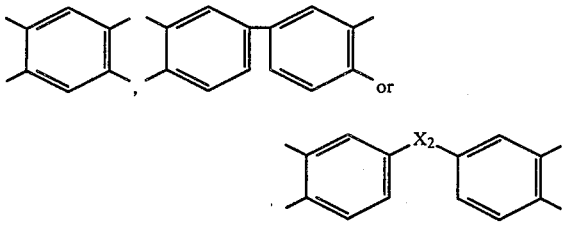

(wherein $X_2$ is —O— or —CO—).

5. Fibers according to claim 1, wherein the polymer is a wholly aromatic polyamide-imide having a repeating unit of the formula:

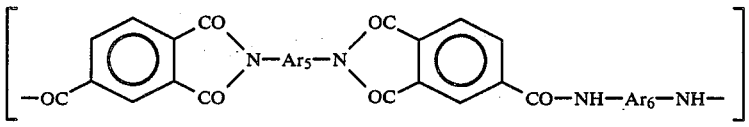

wherein $Ar_5$ is a divalent phenylene residue of the formula:

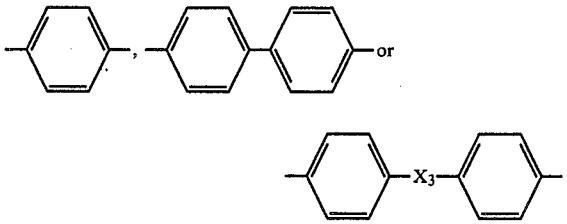

(wherein $X_3$ is —$CH_2$—, —O—, —S—, —SO—, —$SO_2$— or —CO—); and $Ar_6$ is a divalent group of the formula:

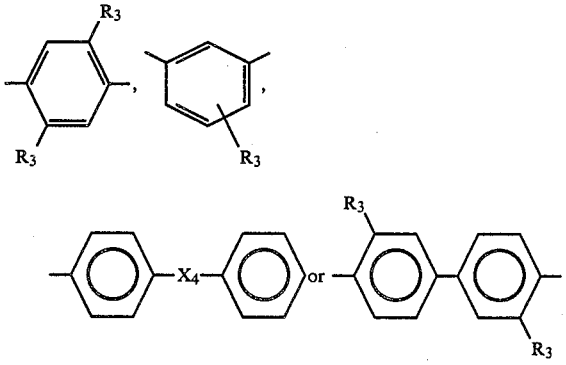

(wherein $R_3$ is hydrogen or a lower alkyl group having 1 to 4 carbon atoms; and $X_4$ is —$CH_2$—, —O— or —CO—).

6. A process for producing heat resistant organic synthetic fibers which comprises the steps of:

wet-spinning a solution of a wholly aromatic polymer having amide group and/or imide group;

subjecting the resulting spun filaments to wet heat stretching;

washing the filaments with water;

drying the filaments; and subjecting the dried filaments to dry heat stretching to obtain crystalline fibers;

said stretching satisfying the formulas:

$$DD/WD \geqq 2,$$

$$DD \geqq 100\%, \text{ and}$$

$$TD \geqq 200\%$$

wherein DD is a dry draw ratio (%); WD is a wet draw ratio (%); and tD is a total draw ratio (%);

said wholly aromatic polymer being obtained from a combination of monomers selected from the group consisting of (a) an aromatic polyisocyanate and an aromatic polycarboxylic acid, (b) an aromatic polyisocyanate and an aromatic polycarboxylic acid anhydride, (c) an aromatic polyamine and an aromatic polycarboxylic acid, (d) an aromatic polyamine and an aromatic polycarboxylic acid halide, and (e) an aromatic polyamine and an aromatic polycarboxylic acid ester.

7. A process according to claim 6, wherein wet heat stretching satisfies the formulas:

$$25 \leqq S \leqq 150,$$

$$1 \leqq D \leqq 50,$$

$$10 \leqq C \leqq 50,$$

$$15 \leqq C+D \leqq 80, \text{ and}$$

$$40 \leqq Tw \leqq 120$$

wherein S is a solvent content (%) of a polymer; D is a solvent concentration (% by weight) of a wet stretching bath; C is a metal salt concentration (% by weight) of a wet stretching bath; and Tw is a temperature (°C.) of a wet stretching bath.

8. A process according to claim 6, wherein dry heat stretching satisfies the formulas:

$$350 \leqq Td \leqq 450, \text{ and}$$

$$100 \leqq DD \leqq 300$$

wherein wherein Td is a temperature (°C.) of dry stretching; DD is a dry draw ratio (%).

* * * * *

UNITED STATES PATENT AND TRADEMARK OFFICE

CERTIFICATE OF CORRECTION

PATENT NO. : 4,758,649

DATED : July 19, 1988

INVENTOR(S) : Shoji Asano et al

It is certified that error appears in the above-identified patent and that said Letters Patent is hereby corrected as shown below:

Claim 6 (column 24, line 20), "tD" should be --TD--.

Signed and Sealed this

Twentieth Day of December, 1988

*Attest:*

DONALD J. QUIGG

*Attesting Officer*

*Commissioner of Patents and Trademarks*